US006494755B2

(12) United States Patent
Kato

(10) Patent No.: US 6,494,755 B2
(45) Date of Patent: Dec. 17, 2002

(54) FUEL SYSTEM FOR OUTBOARD MOTOR ENGINE

(75) Inventor: Masahiko Kato, Hamamatsu (JP)

(73) Assignee: Sanshin Kogyo Kabishiki Kaisha, Shizuoka-ken (JP)

( * ) Notice: Subject to any disclaimer, the term of this patent is extended or adjusted under 35 U.S.C. 154(b) by 0 days.

(21) Appl. No.: 09/834,743

(22) Filed: Apr. 13, 2001

(65) Prior Publication Data

US 2002/0052157 A1 May 2, 2002

(30) Foreign Application Priority Data

Apr. 13, 2000 (JP) ..... 2000-111561

(51) Int. Cl.[7] ..... B63H 21/38

(52) U.S. Cl. ..... 440/88; 123/445; 123/496

(58) Field of Search ..... 440/88; 123/406.26, 123/445, 446, 496

(56) References Cited

U.S. PATENT DOCUMENTS

| | | | |
|---|---|---|---|
| 4,820,215 | A | 4/1989 | Mizusawa et al. |
| 5,598,827 | A | 2/1997 | Kato |
| 5,720,254 | A | 2/1998 | Yoshida et al. |
| 5,732,685 | A | 3/1998 | Nakamura |
| 5,865,160 | A | 2/1999 | Kato |
| 5,951,342 | A | 9/1999 | Ozawa et al. |
| 6,032,638 | A | 3/2000 | Kato |
| 6,032,654 | A | 3/2000 | Kato |
| 6,067,966 | A | 5/2000 | Saito et al. |
| 6,070,564 | A | 6/2000 | Hiraoka et al. |

*Primary Examiner*—Jesus D. Sotelo
(74) *Attorney, Agent, or Firm*—Knobbe, Martens, Olson & Bear LLP

(57) ABSTRACT

A fuel system for an outboard motor includes a plurality of high-pressure pumps and a conduit circuit with a multi-branched passage connecting the engine's combustion chamber(s) to the fuel supply. At least two sections of the conduit circuit may be connected together at a point downstream of the high-pressure pumps. The high-pressure pumps also may be driven by a common pump drive unit, which may be designed to drive the pumps in a manner providing a generally uniform flow of fuel.

26 Claims, 8 Drawing Sheets

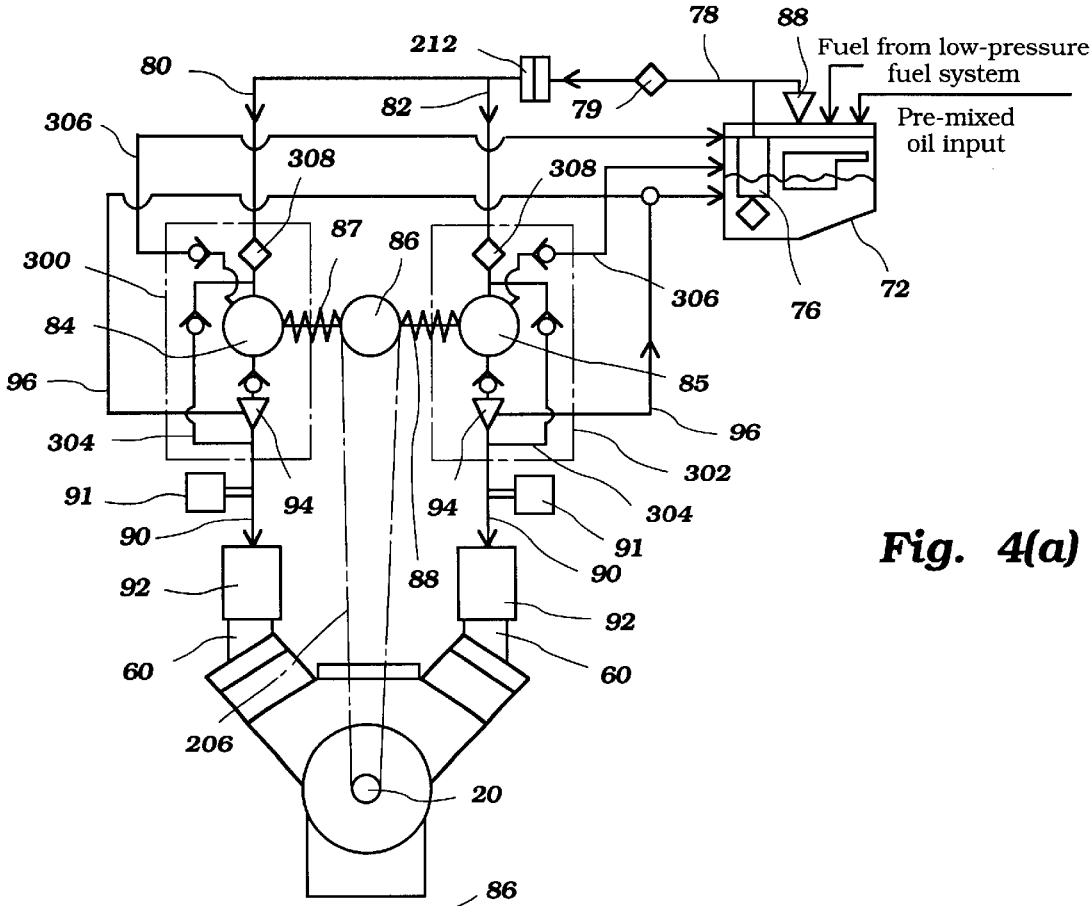
Fig. 4(a)
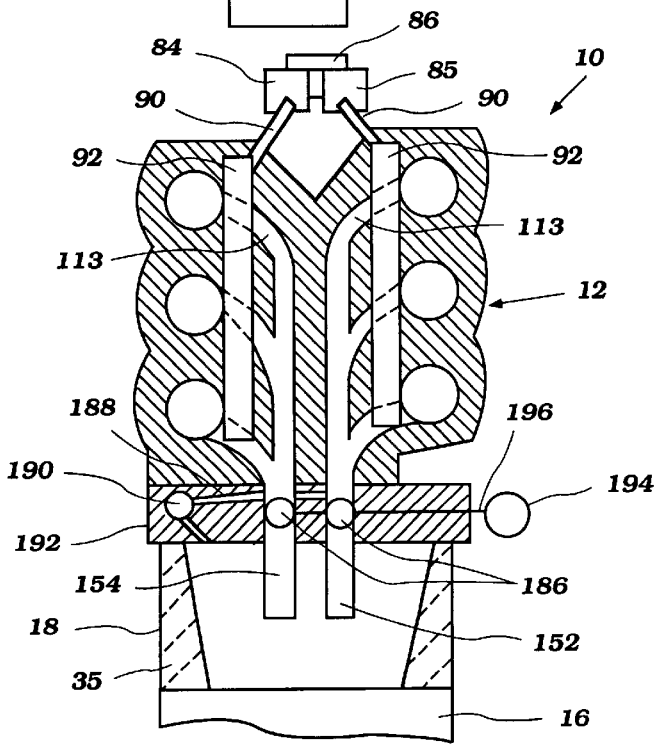
Fig. 4(b)
Figure 4

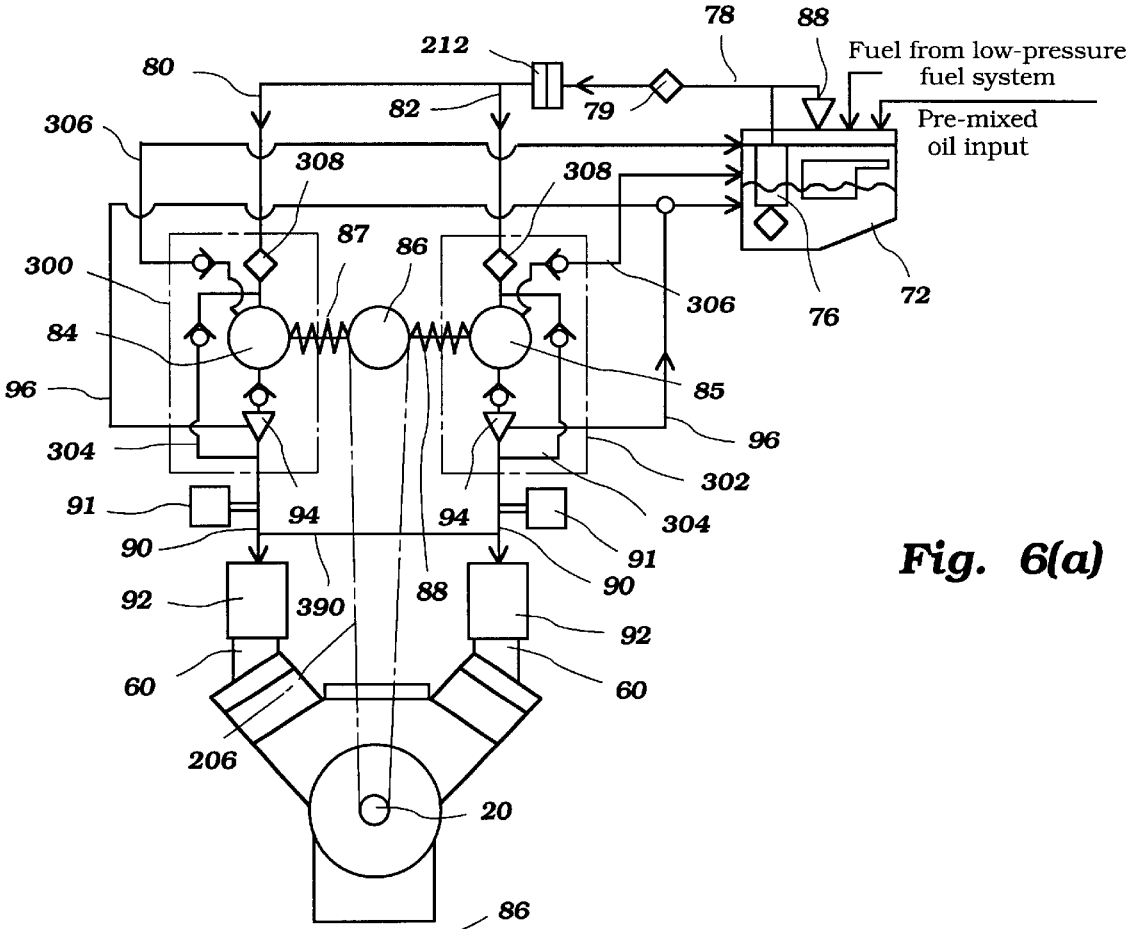
Fig. 6(a)
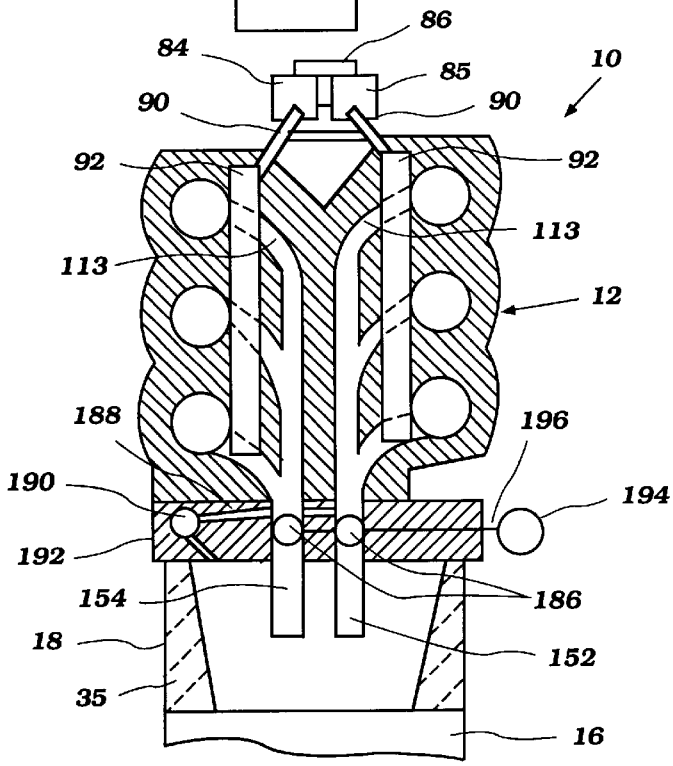
Fig. 6(b)
Figure 6

FUEL SYSTEM FOR OUTBOARD MOTOR ENGINE

PRIORITY INFORMATION

This application is based on and claims priority to Japanese Patent Application No. 2000–111561, filed Apr. 13, 2000, the entire contents of which is hereby expressly incorporated by reference.

BACKGROUND OF THE INVENTION

1. Field of the Invention

The present invention generally relates to the fuel system for internal combustion engines. In particular, the present invention relates to arrangement and structure of a fuel injection system for use with a multi-bank engine (e.g., a V-type engine).

2. Description of the Related Art

Outboard motors often are mounted on transoms of power boats and similar watercraft to power such crafts. In this position, a powerhead of the outboard motor usually extends above the transom. The powerhead desirably is as compact as possible in order to minimize drag on the watercraft and to lessen any obstruction it may cause to the views of the boat's occupants who are looking backwards. The powerhead thus affords only limited space for the engine and the associated components. One such component is the fuel system.

In order to improve the performance of engines employed in outboard motors, it has been proposed to utilize direct cylinder fuel injection in outboard motor fuel systems. Such direct injection systems, especially 2-cycle engines, generally require higher pressure pumps than utilized with normal manifold-type fuel injection systems. This is because in a two-cycle engine the fuel must be injected at a pressure higher than that in the combustion chamber when the ports are closed. This pressure is considerably higher than the pressure in the induction system, which is where conventional manifold injectors inject and which is usually at or below atmospheric pressure.

On the other hand, it is generally undesirable to store and/or maintain fuel at very high pressures over long lengths of time and distance. It therefore is preferred to provide and drive high-pressure pumps in the powerhead to elevate the fuel to the pressure required at the injectors. Because of the high pressures required, some fuel systems use an engine-driven high-pressure pump rather than an electrically-operated fuel pump. Also, some systems use a series of pumps to elevate the fuel pressure to achieve the required pressures. Employing multiple fuel pumps unfortunately can greatly increase the number of parts in the fuel system, complicating assembly and maintenance, and also leaving little space for the other engine components.

SUMMARY OF THE INVENTION

An aspect of the present invention involves an outboard motor comprising a powerhead including an internal combustion engine. The engine has at least one variable-volume combustion chamber formed by at least a pair of members. One member is movable relative to the other member. A crankshaft is coupled to the one member and is journaled for rotation within the engine. Ann intake system is configured to provide air to the combustion chamber. A fuel system includes a fuel supply system and at least one fuel injector that is connected to the fuel supply system and is arranged to provide fuel to the at least one combustion chamber. The fuel supply system comprises a fuel circuit including a plurality of conduits and having a multi-branched portion. A plurality of high pressure fuel pumps are disposed in separate branches of the multi-branched portion. A vapor separator is disposed between a fuel filter and the multi-branched portion. At least one of the branches of the multi-branched section loops back to form a looped branch in the fuel circuit to communicate with the vapor separator.

Another aspect of the present invention involves an internal combustion engine comprising a pair of cylinder banks. Each bank has at least one cylinder, and a fuel injector is mounted on each of the banks and is arranged to provide fuel to the respective cylinder. A fuel system comprises a fuel circuit, which extends between a fuel tank and the fuel injectors. A plurality of high pressure fuel pumps are disposed within the fuel circuit. Each of the pumps is connected to a respective fuel injector to supply high pressure fuel to the injector. The pumps are arranged within the fuel circuit such that the inlet of one pump does not communicate with the outlet of another.

In accordance with another aspect of the present invention, an outboard motor is provided comprising an internal combustion engine. The engine has at least one variable-volume combustion chamber formed by at least a pair of members. One member is movable relative to the other member. A crankshaft is coupled to the one member and is journaled for rotation within the engine. An intake system is configured to provide air to the combustion chamber. A fuel system includes a fuel supply system and at least one fuel injector that is connected to the fuel supply system and is arranged to provide fuel to the at least one combustion chamber. The supply system comprises at least two high pressure fuel pumps and a pump drive unit arranged to drive the two high pressure pumps.

An additional aspect of the present invention involves an outboard motor comprising an internal combustion engine. The engine has at least one variable-volume combustion chamber formed by at least a pair of members. One member is movable relative to the other member. A crankshaft is coupled to the one member and is journaled for rotation within the engine. An intake system is configured to a provide air to the combustion chamber. A fuel system includes a fuel supply system and at least one fuel injector that is connected to the fuel supply system and is arranged to provide fuel to the at least one combustion chamber. The fuel supply system comprises a fuel circuit including a plurality of conduits and having a multi-branched portion. The fuel supply system also includes a plurality of high pressure fuel pumps. The pumps are disposed in separate branches of the multi-branched portion.

Further aspects, features and advantages of the present invention will become apparent from the following description of the preferred embodiments.

BRIEF DESCRIPTION OF THE DRAWINGS

The above-mentioned and other features of the invention will now be described with reference to the drawings of the preferred embodiments of the present fuel system in the context of an outboard motor. The illustrated embodiments of the fuel system are intended to illustrate, but not to limit the invention. The drawings contain the following figures:

FIG. 4 is a schematic two-view drawing showing the outboard motor and components of the engine. View 4(*a*) is an enlarged view of View 1(*a*) and shows the engine and its fuel system in greater detail. View 4(*b*) is an enlarged view of View 1(*b*) and shows a rear elevational view of the upper portion of the outboard motor.

FIG. 6 is a two-view drawing, similar to FIG. 4, but showing a fuel system configured in accordance with another preferred embodiment.

FIG. 8(*a*) illustrates the characteristics of a cam having an even number of crests. FIG. 8(*b*) illustrates the characteristics of a cam having an odd number of crests.

DETAILED DESCRIPTION OF THE PREFERRED EMBODIMENT

Figure 1:
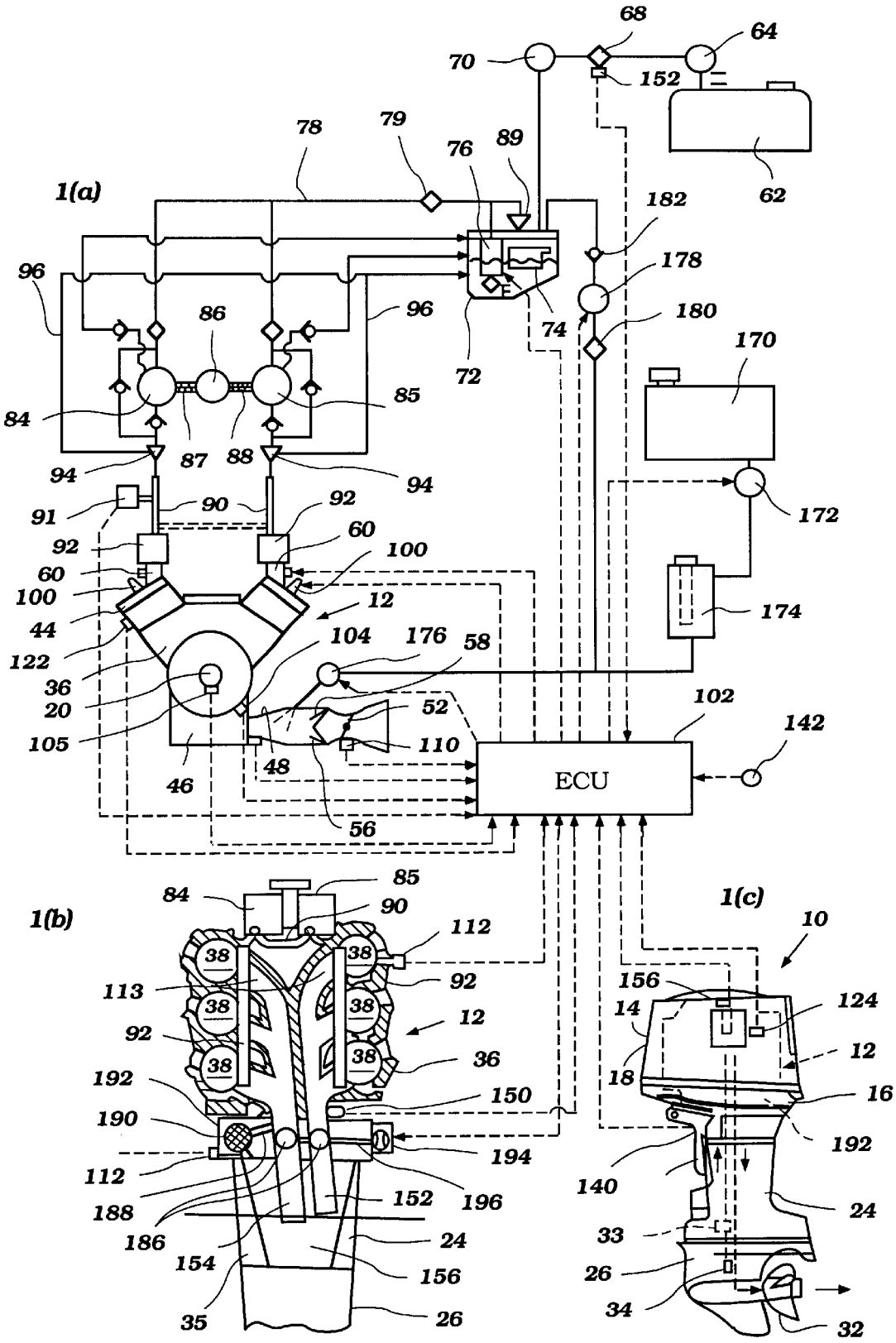
FIG. 1 is a schematic three-view drawing showing an outboard motor and components thereof View 1(*a*) schematically shows an engine of the outboard motor and certain systems associated with it, including a fuel system configured in accordance with a preferred embodiment of the present invention. View 1(*b*) is a rear elevational view of the upper portion of the outboard motor with a portion of a protective cowling removed and with the engine shown partially in cross-section. View 1(*c*) is a side elevational view of the outboard motor with certain internal components of the engine shown in phantom.

With reference to the drawings and initially to FIG. 1(*c*), an outboard motor which includes a fuel system constructed in accordance with a preferred embodiment of the invention, is identified generally by the reference numeral 10. The general overall construction of the outboard motor 10 may be of any conventional type. While the present fuel system is described in the context of an outboard motor, it is understood that it can be used with engines designed for other applications (for example, but without limitation an inboard motor).

The powerhead 14 includes, in addition to the engine 12, a protective cowling that comprises a lower tray portion 16 to which a removable upper main cowling 18 is detachably connected in the manner known in the art.

As is conventional outboard motor practice, the engine 12 is mounted in the powerhead 14 so that the crankshaft 20 rotates about a vertically disposed axis. This is to facilitate connection of the crankshaft 20 to a drive shaft which depends into and is journaled within a drive shaft housing 24. The drive shaft housing 24 is positioned beneath the powerhead 14.

The drive shaft continues into a lower unit 26 which forms a portion of a drive shaft housing and lower assembly. As is known, a transmission provided in the lower unit 26 selectively drives a power shaft. The power shaft in turn is connected to a watercraft propulsion device such as a propeller 32. That is, the propeller 32 is affixed onto an end of the power shaft in the illustrated embodiment.

The engine 12 preferably is provided with a cooling system. In the illustrated embodiment, the cooling system comprises a water pump 33 that is located within the drive shaft housing 24 positioned beneath the powerhead 14. The cooling system also includes a water inlet 34 which comprises an opening in the lower unit through which water from the body of water in which the motor 10 operates may be drawn for cooling at least the components of the engine. The drive shaft housing further comprises a cooling water passage 35 (see FIG. 1(*b*)). A column of cooling water flows through the passage 35 to the engine 12 to cool it.

The outboard motor 10 also includes a mounting mechanism 37 for connection to the associated watercraft hull. As is also typical with outboard motor practice, the mounting mechanism 37 includes a swivel bracket (not shown) for steering movement about a vertically extending steering axis. The mounting mechanism 37 also may provide for a tilt and trim movement of the outboard motor 10 relative to the associated watercraft hull. The structure of the mounting mechanism 37 may be of any conventional type.

The construction of the engine 12 will now be described particularly by reference principally to FIGS. 1(*a*) and 1(*b*). In the illustrated embodiment, the engine 12 is depicted as being of a two-cycle, crankcase compression type having six cylinders arranged in a V orientation. It should be apparent, however, that the fuel system can be utilized with a wide variety of engine types and engines having other numbers of cylinders and other cylinder configurations. Also, the fuel system can be utilized with four-cycle and rotary engines. However, the fuel system has particular utility with multiple cylinder engines. It is also understood that certain aspect of the present fuel system can be used with port injected or indirect injection systems; however, the following embodiments illustrate the fuel system as a direct injection system because of its particular utility in this application.

The engine 12 is comprised of a cylinder block 36 which has a pair of cylinder banks that are orientated in a V-shape with divergence rearward in the powerhead 14. Cylinder bores 38 are formed in each cylinder bank of the cylinder block 36 and receive respective pistons 40 that reciprocate within the bores. Connecting rods 42 connect the pistons 40 to the throws of the crankshaft 20. A cylinder head assembly 44 is attached to each cylinder bank. The pistons 40, cylinder bores 38, and cylinder head assemblies 44 form the combustion chamber 45 of the engine.

The crankshaft 20 rotates within a crankcase chamber that is formed by the skirt of the cylinder block 36 and a crankcase member 46 that is detachably connected thereto. This crankcase chamber is divided into individually sealed compartments, each of which is associated with a respective one of the cylinder bores 38 in a manner well known in the two-cycle engine art.

An intake charge is delivered to these crankcase chambers by an induction system which is shown schematically in FIG. 1(*a*) and which appears in greater detail in FIGS. 4 and 6. This induction system includes an air inlet device 48 which may include a silencer or plenum chamber 49 configured to provide silencing of the inducted air. This air is drawn from within the protective cowling 18 in a manner well known in the outboard motor art. The main cowling member 18 and/or tray 16 may be formed with a suitable air inlet so the atmospheric air can enter into the interior of the protective cowling. This inlet preferably is designed in such a way so as to minimize the intake of water into the interior of the protective cowling of the powerhead 14.

Figure 3:
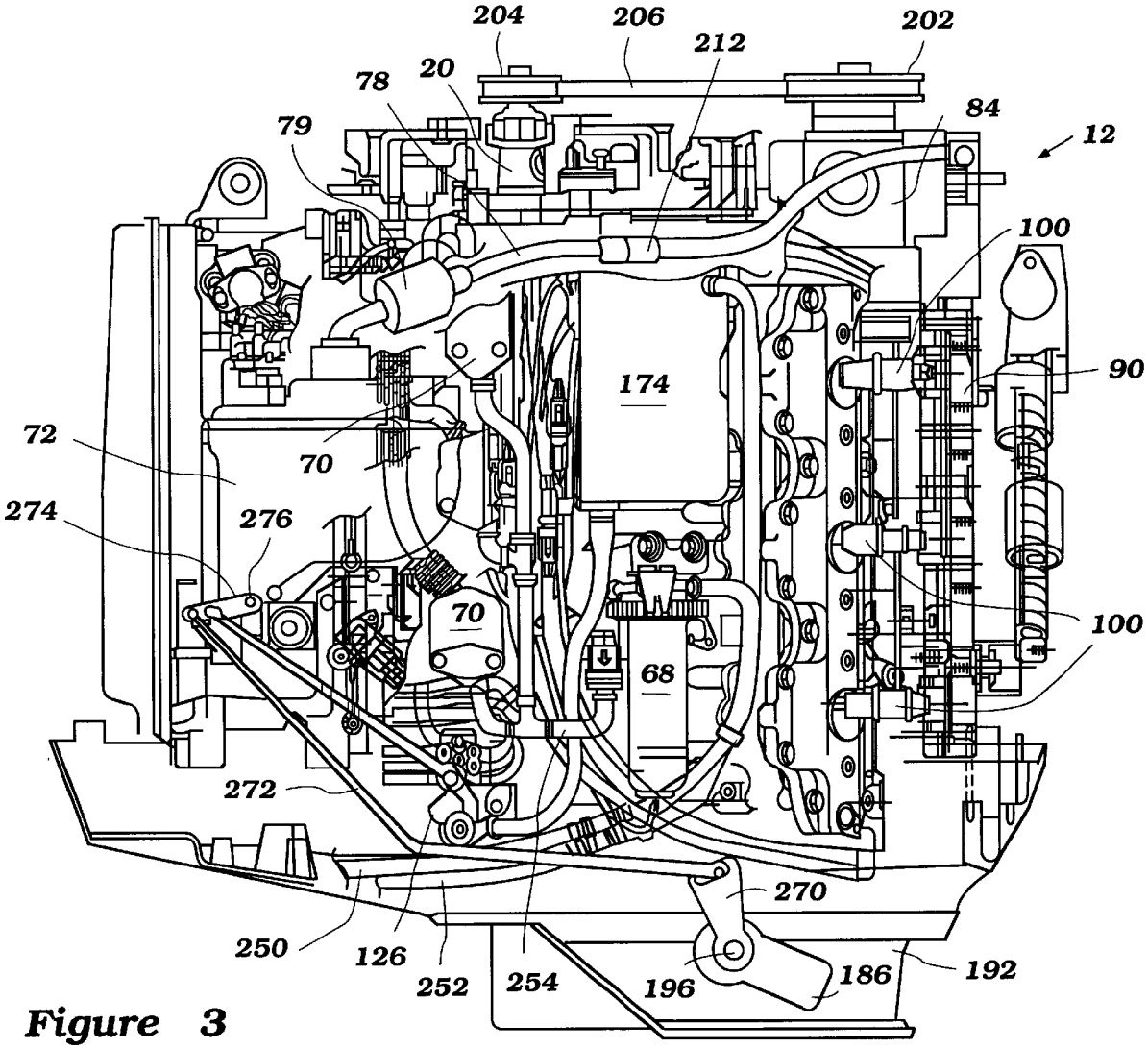
FIG. 3 is a side elevational view of the engine illustrating the fuel system. An upper member of the cowling has been removed and a lower tray portion has been broken away to view the lower end of the engine.

The air inlet device 48 supplies the inducted air to throttle bodies 50 which are in the illustrated embodiment disposed on the crankcase member 46 at the front of the powerhead 14. Throttle valves 52 mounted on the throttle bodies 50 are controlled by a suitable linkage system for controlling the speed at which the engine 12 operates. The linkage system, shown in FIG. 3, is described in greater detail below. The throttle bodies 50 communicate with intake conduits of an intake manifold so as to supply the air charge to the aforenoted crankcase chamber sections. Reed-type valves 56 are disposed at one end of the manifold where they communicate with intake ports 58 for delivering the air charge to the crankcase chamber sections.

Reed-type check valves 56 operate, in the manner well known in the art, so as to permit the air charge to flow into the crankcase chamber sections when the pistons 40 are moved upwardly in the cylinder bore 38. As the pistons begin their downward stroke, however, the reed-type check valve 56 will close so as to permit the charge to be compressed in the crankcase chamber sections without escape therefrom.

Upon continued downward movement, the pistons 40, scavenge ports (not shown) will open to communicate the crankcase chamber sections with the combustion chambers 45 in a manner well known in this art. The charge is then transferred to the combustion chambers 45 for further compression therein.

A fuel system is also provided for engine 12, and will be described generally with respect to FIG. 1 and more specifically with respect to FIGS. 4 and 6. In the illustrated embodiment, fuel is mixed with this compressed air charge for providing the motor power for the engine 12. The fuel is sprayed directly into the combustion chambers 45 by fuel injectors 60 that are mounted in the cylinder head assemblies 44 and discharge directly into the combustion chambers 45. These fuel injectors 60 are supplied with fuel under pressure by a fuel supply system, shown generally in FIG. 1(*a*), where the components are illustrated primarily in schematic fashion.

The fuel supply system includes a fuel circuit, which is formed by a plurality of conduits, and a remotely-positioned fuel tank 62, which generally is located in the hull of the associated watercraft. A primer pump 64 delivers fuel to a supply conduit 66 of the fuel circuit which has a quick disconnect connection to the powerhead 14, and specifically to the fuel filter 68 positioned in the powerhead 14.

The fuel filter 68 filters fuel that is drawn by a low-pressure pump or pumps 70. These pumps 70 may be driven by the pressure variation in the crankcase chamber sections, or in some other manner (e.g., by an electric motor). The pumped fuel is then delivered to a vapor separator assembly 72 that is mounted within the powerhead 14.

A uniform level of fuel is maintained in the vapor separator 72 by a float-operated valve 74 that controls the admission of fuel into the vapor separator 72. A high-pressure, electrically-driven fuel pump 76 is mounted in this vapor separator and collects the fuel and delivers it to a conduit circuit 78 of the fuel circuit. In the illustrated embodiment, the electric pump can supply fuel at about 3–10 kg/cm$^2$ of pressure.

Figure 2:
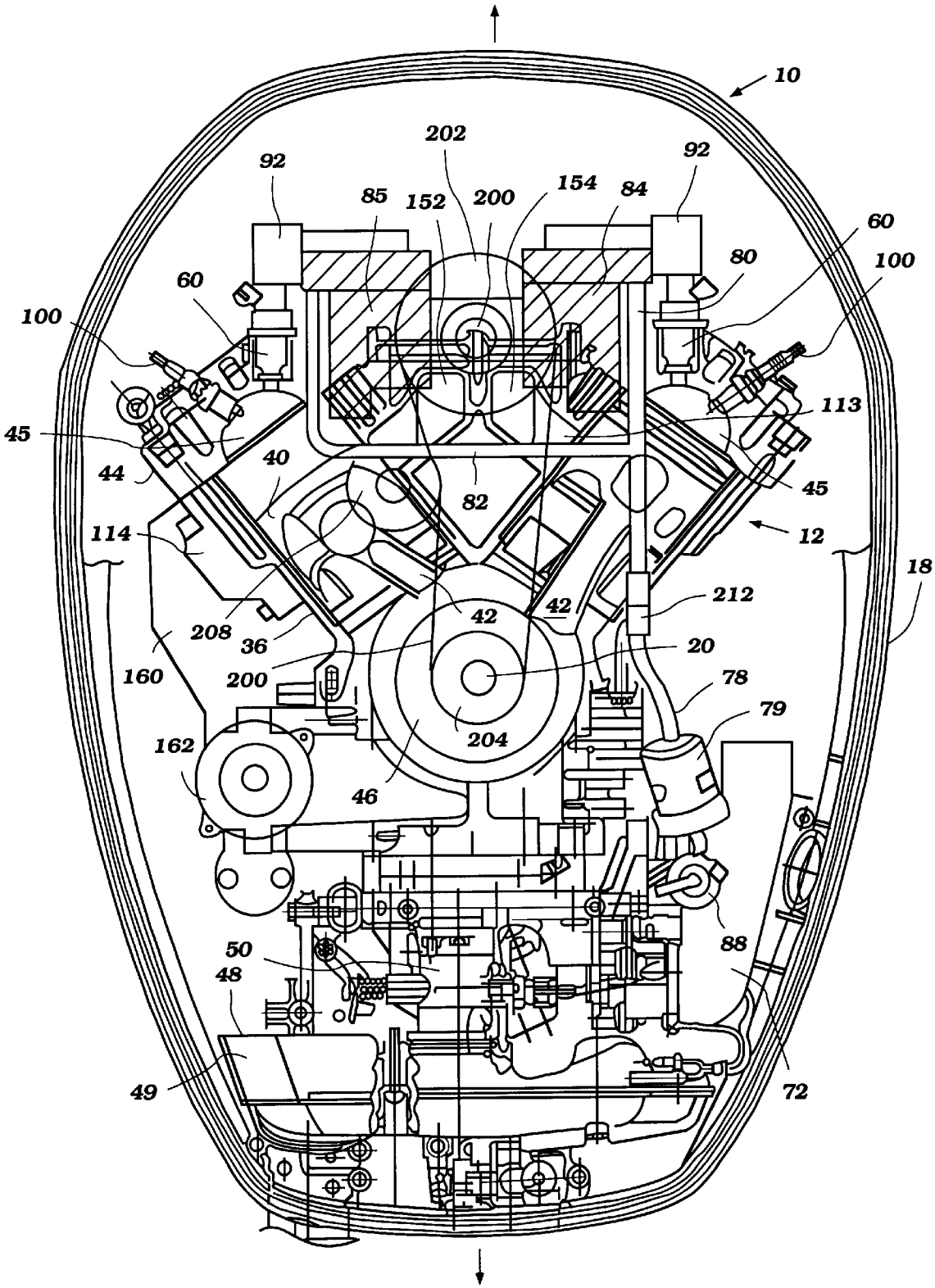
FIG. 2 is a top plan view of the engine of the powerhead showing the engine in the same orientation as View 1(*a*), with portions of the engine broken away to illustrate the internal construction.

A fuel filter 79 may be positioned in a pre-pressure fuel line of the fuel circuit 78. As shown in FIGS. 1–3, the conduit circuit 78 is disposed downstream of the vapor separator 72 and comprises a multi-branched portion having branches 80, 82. The branches 80, 82 of the conduit circuit 78, in turn, communicates with the inlet side of high-pressure fuel pumps 84, 85. The high-pressure pumps 84, 85 are preferably of the plunger or piston type, being driven by a pump drive unit 86 through plungers 87, 88. The pump drive unit is driven from the engine crankshaft 20 in a manner which will be described later.

The pressure at which fuel is supplied to the high-pressure pump pumps 84, 85 is controlled by a low-pressure stage regulator 89 that is provided in the line 78 and which regulates the delivery pressure by dumping excess fuel back to the vapor separator 72.

The high-pressure pumps 84, 85 in turn deliver fuel under pressure to main fuel manifolds 90, which preferably are located in the valley between the cylinder banks. A fuel pressure sensor 91 is provided to provide fuel manifold pressure measurements to an electronic control unit ("ECU"), which is described in more detail below. The main fuel manifolds 90, in turn, communicate with fuel rails 92, each of which is associated with the fuel injectors 60 associated with a respective one of the cylinder banks. FIG. 1 illustrates that a balance passage (shown in phantom) can connect the fuel manifolds 90 together in order to balance pressure fluctuations in the lines. This feature will be discussed in more detail in connection with the embodiment illustrated in FIGS. 6–8.

A high-pressure regulator 94 is provided in communication with each of the main fuel manifolds 90. In the illustrated embodiment, the regulator 94 can maintain the fuel at this section of the fuel circuit at 50–100 kg/cm$^2$. The regulator 94 regulates the pressure delivered to the injectors 60 by dumping fuel back to the vapor separator through a return line 96. A heat exchange (not shown), or fuel cooler, can be provided in this return line for altering the temperature of the fuel being returned to the vapor separator.

The fuel is injected directly into the combustion chambers 45, as aforenoted, by the injectors 60. The specific fuel control system and strategy therefor may be of any known type. This fuel mixed with the compressed air and then is ignited by spark plugs 100 that are mounted on the cylinder head assemblies 44. The spark plugs 100 are fired by an ignition circuit under the control of the ECU 102.

The ECU 102 controls the timing and firing of spark plugs 100 and beginning and duration of fuel injection by the injector 60. To this end, a number of sensors are provided that sense engine running conditions, ambient conditions, or conditions of the outboard motor 10 that will affect engine performance. Certain of the sensors are shown schematically in FIG. 1 and will be described by reference to that figure. It should be readily apparent to those skilled in the art, however, that other types of sensing and control arrangements may be provided.

The crank angle sensor 104 is associated with the crankshaft 20. This sensor 104 provides not only signal of crank angle but, by comparing that signal with time, indication of the crankshaft rotational speed. There is also provided a crankcase pressure sensor 105 which senses the pressure in one or all of the crank chambers. By measuring crankcase pressure at a particular crank angle, the engine induction amount can be determined.

Engine or operator demand is determined by throttle position sensor 110 that operates in conjunction with throttle valve 52 so as to determine this function. The ECU 102 operates on a feedback control condition and thus, an air/fuel ratio sensor 112 is provided that communicates with the combustion chamber 45 or exhaust port 113 of at least one of the cylinders. Preferably, an oxygen sensor is utilized for this purpose, although other types of devices may be employed.

To provide a good indication of the fuel/air ratio, the oxygen sensor 112 is positioned so that it will sense the combustion products near the completion of combustion and before a fresh charge of air is delivered to the combustion chamber 45. Preferably the oxygen sensor's probe opens into the cylinder bore at a point that is disposed slightly vertically above the upper edge of the exhaust port 113. In this way, the oxygen sensor 112 will be in a position to receive combustion products immediately before the opening of the exhaust port 113 and before the opening of the scavenge ports so that it will sense the combustion products at the time combustion has been substantially completed. As shown in FIG. 2, the oxygen sensor is provided with an oxygen sensor cover 114 which protects the sensor from damage Engine temperature is sensed by engine temperature sensor 122.

The temperature of the cooling water drawn from the body of water in which the watercraft or outboard motor 10 is operated is measured by water temperature sensor 124.

Other sensors can be used for component control and some of these are associated with the engine 12 of the outboard motor 10 itself. These may include an engine vibration or knock sensor 142. There also may be provided an exhaust back-pressure sensor 150 in one of the right or left exhaust manifolds 152, 154. A water detection sensor 152 is also provided at the fuel filter 68. Also, an oil level sensor 156 may also be provided.

Of course, the sensors described are only typical of those types of sensors which can be used. As will be recognized, more or less sensors can be used with an engine that is configured and arranged with certain features of the present inventions.

The engine 12 is also provided with a lubricating system that includes a primary oil tank 170 and an oil pump 172. The oil pump 172 provides oil from the primary oil tank 170 to the secondary oil tank 174, an oil pump 175, which supplies lubricant to lubricant injectors 176 in a controlled manner. These injectors 176 spray into the air inlet device 48 or, alternatively, deliver lubricant to the moving components of the engine for direct lubrication. The lubrication system also comprises a pre-mixing oil pump 178 which provides oil to the vapor separator assembly 72 of the fuel system. A filter 180 may be disposed between the secondary oil tank 174 and the pre-mixing oil pump 178. A checkvalve 182 may be disposed between the pre-mixing oil pump 178 and the vapor separator assembly 72. Any type of lubricating system may be employed, and this is controlled, like the fuel injectors 60 and spark plugs 100, by a suitable control in accordance with any desired strategy.

The exhaust system of the engine 12 further comprises exhaust valves 186 disposed between the exhaust ports 113 and the exhaust manifolds 152, 154. A sub-exhaust passage 188 communicates with the catalyst 190 in the exhaust guide plate 192. Exhaust valves 186 are driven by the exhaust valve driving motor 194 to which they are connected by valve shaft 196. Each exhaust manifold 152, 154 communicates with an expansion chamber 156 which is formed in the drive shaft housing 24.

The engine 12 may be provided with other components, such as electrical components of various types. These components may be sensitive to the environment inside the motor cowling 18, and thus may require a electric component box 160. Also, the engine may be provided with a starter motor 162, as is well known in the art.

With reference to FIG. 2, the fuel system will now be described in greater detail. The pump drive unit 86 will be discussed in greater detail. The pump drive unit 86 comprises a cam shaft 200 which is journaled in the valley between the cylinder banks. A cam pulley 202 is fixed to the cam shaft 200. A drive pulley 204 is connected to the crank shaft 20. A drive belt 206 is mounted on both pulleys 202, 204. A tension pulley 208 acts against the drive belt 206 to increase the tension in the belt. In this arrangement, rotation of the crankshaft 20 causes drive pulley 204 to rotate. This rotation is transmitted to cam pulley 202 through drive belt 206, causing the cam pulley 202 also to rotate. Of course, a drive chain or other suitable transmitter can be used in place of the drive belt 206.

Also with reference to FIG. 2, a fuel connector 212 can be provided in the conduit circuit 78, but need not be. This connector preferably is located between the fuel filter 79 and the point at which the circuit 78 divides into branches 80, 82. The fuel connector is described in greater detail with respect to FIG. 5.

With reference to FIG. 3, the fuel system comprises low pressure fuel conduits 250, 252 connected to an inlet side of the fuel filter 68. Also, a low pressure fuel conduit 254 is connected to an outlet side of the fuel filter 68. A low pressure pump 70 is connected to the conduit 254 and draws fuel from the filter 68 toward the engine 12.

A linkage system is also provided which comprises a linkage 270 connected to valve shaft 196, a link rod 272 connecting to the linkage 270, a linkage 274 connected to the link rod 272. The linkage 274 is also connected to the throttle shaft 276. Through this linkage system, rotation of the throttle valves 52 in the throttle bodies 50 causes corresponding rotation of the throttle shaft 276. This rotation causes a coordinated movement of the exhaust valves 186.

FIG. 4 shows an enlarged view of the Views A and B of FIG. 1. In particular, the high pressure pump units 300, 302 are shown in greater detail. In addition to the features of the high pressure pump units 300, 302 described above with reference to FIG. 1, the pump units also comprise bypass conduits 304 which are connected to each of the main fuel manifolds 90 downstream of the high-pressure regulators 94. The bypass conduits 304 are connected to branches 80, 82 upstream of the high-pressure pumps 84, 85 and contain check valves. The check valves are sized to open when at a preset pressure so as to allow fuel to bypass the high pressure pump and flow into the fuel manifold should a malfunction of the pump or pressure regulator 88 occur.

Return conduits 306 connect the pumps 84, 85 to the vapor separator 72. Filters 308 are positioned in the branches 80, 82 upstream of the pumps 84, 85, as shown in FIG. 4. Also shown in FIG. 4, as described above, a fuel pressure sensor 91 is provided to provide fuel manifold pressure measurements to the ECU. In one embodiment, there are pressure sensors 91 positioned in each main fuel manifold 90.

Figure 5:
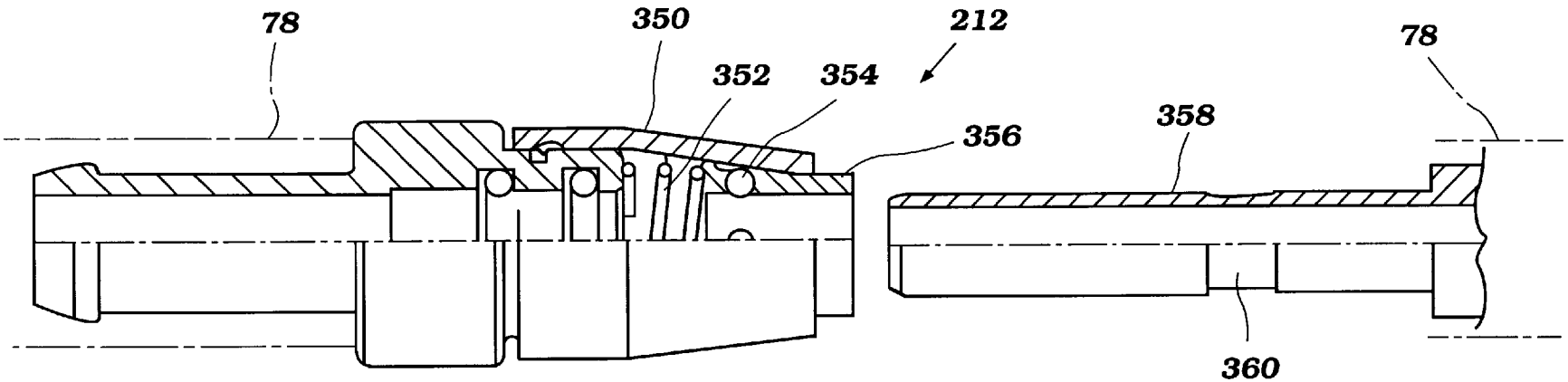
FIG. 5 is a two-view drawing that illustrates in side elevational and cross-sectional views a releasable fuel connector that can be used with the present fuel system. View 5(*a*) shows the connector in a disconnected condition. View 5(*b*) shows the fuel connector in a connected condition.
Figure 5:
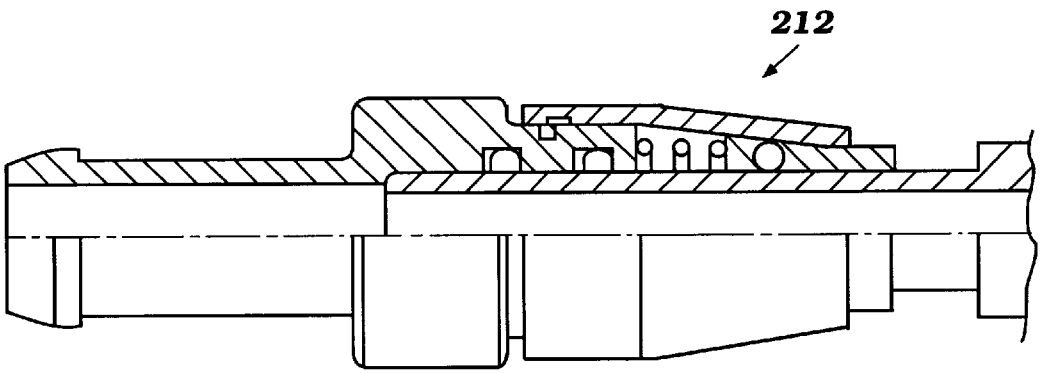

Also, shown schematically in FIG. 4, a fuel connector 212 may be provided in the conduit circuit 78. The fuel connector 212 is shown in greater detail in FIGS. 5(*a*). FIG. 5(*b*) shows the connector in its connected position. As shown in FIG. 5(*a*), the fuel connector female portion 350 is connected to the conduit circuit 78, shown in phantom. The female portion 350 comprises a spring 352 located inside the female portion, a ball 354 and an inlet 356. The male portion 358, comprising a groove, is connected to another portion of the conduit circuit 78, shown in phantom. When the male portion 358 is inserted into the female portion 350, the ball 354 comes to rest in the groove 360 to connect the conduit circuit 78, as shown in FIG. 5(*b*).

As mentioned above, the high-pressure pump drive unit 86 comprises high-pressure pumps 84, 85 which are driven by plungers or pistons 87, 88 as described above, by transferring rotation of the crankshaft 20 into a cam shaft 200. Cam 380, which is mounted on and rotates with cam shaft 200, drives plungers 87, 88 and hence drives pumps 84, 85.

FIG. 6 is a two-view drawing similar to FIG. 4, but showing an example of another embodiment of the fuel system. As shown in FIG. 6, each of the main fuel manifolds 90 is connected to the outlet side of the high-pressure pumps 84, 85. In this further embodiment, a conduit 390, which is located in the valley between the cylinder banks, connects two main fuel manifolds 90. As above, a cam 380 mounted on the camshaft 200 drives the high pressure pumps 84, 85.

Figure 7:
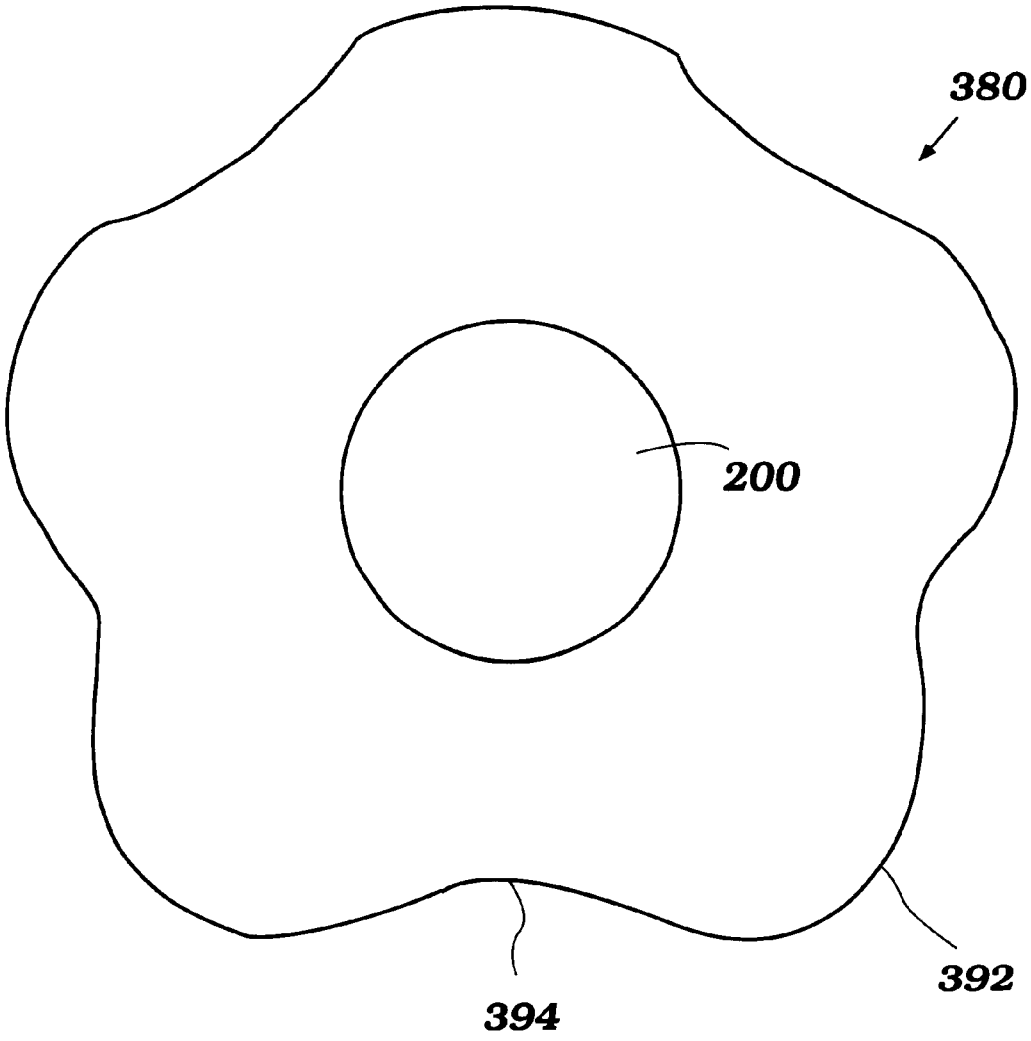
FIG. 7 is a side elevational view of a camshaft and cam assembly of the fuel system of FIG. 6.

In this embodiment, and as further shown in FIG. 7, the cam 380 comprises a plurality of crests 382 and troughs 384. The "crests" correspond to the high points on the cam. Stated another way, the "crests" correspond to the cam portions having the greatest radial distance from the central axis of the cam shaft 200. The "troughs" correspond to the lowest points on the cam 380, having the smallest radial distance from the central axis of the shaft 200. The surface of the cam 380, including the crests and troughs 392, 394, come into contact plungers 87, 88 and actuate them to pump the required amount of fuel at the desired pressure.

Figure 8:
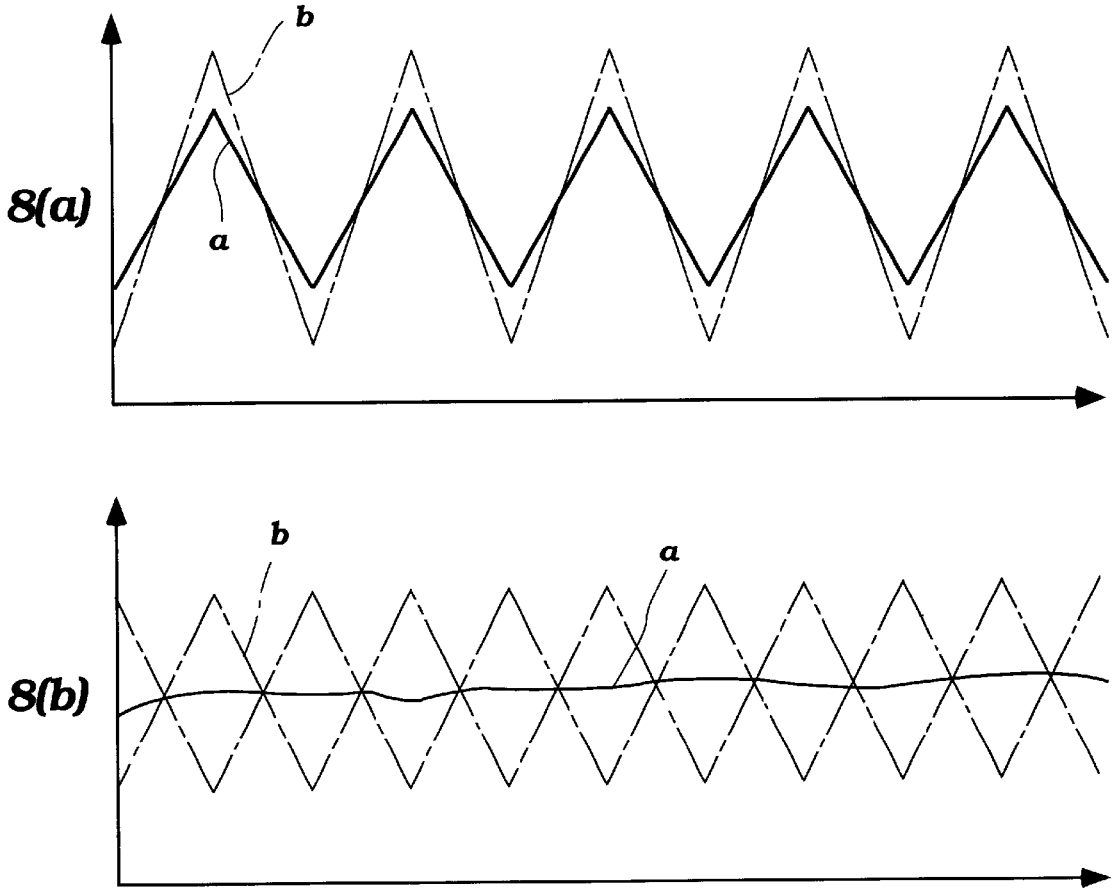
FIG. 8 is a two-view drawing showing pump drive force and fuel pulsation.

FIG. 8, is a graphical representation of the pump drive force and fuel pulsation when the high-pressure pumps 84, 85 are drive by the rotation cam 380. FIG. 8(*a*) shows the fuel discharged from both pumps (labeled as "a") and the fuel pulsation (labeled as "b") for a cam 380 having six crests 382. FIG. 8(*b*) shows the fuel discharge (labeled as "a") and the fuel pulsation (labeled as "b") for a cam 380 having five crests 384. The fuel discharge for a five crest cam 380 is more consistent (i.e., generally uniform pressure and flow), as can be seen. This consistency is provided in part by the conduit 390 which provides for fluid communication between fuel manifolds 90, as well as by the construction of the cam 380. In the illustrated embodiment, the cam is configured and arranged such that while one of the crests of the cam engages one of the plungers, the other plunger is engaged with a trough. The resulting pressure fluctuation patter is shown in FIG. 8(*b*) and illustrates that the pressure waves tend to cancel each other out. Another benefit of this construction, as may be seen in FIG. 1, is that a single fuel pressure sensor 91 may be used since the pressure in the fuel manifolds 90 and conduit 390 will be constant at a given time.

Thus, from the foregoing description, it should be readily apparent that the described embodiments of the invention provide a plurality of pumps for providing fuel at sufficient pressure to achieve direct injection of fuel into the cylinders of a two-cycle engine without completely redundant fuel lines. Of course, the foregoing description is that of preferred embodiments of the invention and various changes and modifications may be made without departing from the spirit and scope of the invention, as defined by the appended claims.

What is claimed is:

1. An outboard motor comprising a powerhead including an internal combustion engine, the engine having at least one variable-volume combustion chamber formed by at least a pair of members, one member being movable relative to the other member, a crankshaft coupled to the one member and journaled for rotation within the engine, an intake system configured to provide air to the combustion chamber, and a fuel system including a fuel supply system and at least one fuel injector connected to the fuel supply system and arranged to provide fuel to the at least one combustion chamber, the fuel supply system comprising a fuel circuit including a plurality of conduits and having a multi-branched portion, a plurality of high pressure fuel pumps, the pumps being disposed in separate branches of the multi-branched portion, a fuel filter, a vapor separator disposed between the fuel filter and the multi-branched portion, and at least one of the branches of the multi-branched section looping back to form a looped branch in the fuel circuit to communicate with the vapor separator.

2. The outboard motor of claim 1, wherein the fuel system also includes a releasable connector disposed between the vapor separator and the multi-branched portion of the fuel circuit.

3. The outboard motor of claim 1, wherein the fuel system additionally comprises a pump drive unit arrange to drive at least two of the plurality of high pressure fuel pumps.

4. The outboard motor of claim 3, wherein the pump drive unit includes a cam mechanism.

5. The outboard motor of claim 1, wherein the fuel system further comprises at least one fuel manifold communicating with at least the looped branch of the fuel circuit, a fuel rail communicating with the fuel manifold, a pressure sensor located in the fuel manifold between the looped branch and the fuel rail.

6. The outboard motor of claim 1, wherein the fuel circuit includes at least two looped branches and the fuel system comprises a pair of fuel manifolds, a pair of fuel rails and a pair of fuel sensors, each fuel manifold communicating with one of the looped branches and each fuel rail communicating with one of the fuel manifolds, and each fuel sensor being disposed in one of the fuel rails between the corresponding looped branch and fuel rail.

7. The outboard motor of claim 6, wherein the fuel system includes a passage that connects together sections of the fuel circuit on the outlet sides of the high-pressure pumps.

8. The outboard motor of the claim 7, wherein the passage links together the fuel manifolds.

9. An outboard motor comprising an internal combustion engine, the engine having at least one variable-volume combustion chamber formed by at least a pair of members, one member being movable relative to the other member, a crankshaft coupled to the one member and journaled for rotation within the engine, an intake system configured to provide air to the combustion chamber, and a fuel system including a fuel supply system and at least one fuel injector connected to the fuel supply system and arranged to provide fuel to the at least one combustion chamber, the fuel supply system comprising a fuel circuit including a plurality of conduits and having a multi-branched portion, a plurality of high pressure fuel pumps, the pumps being disposed in separate branches of the multi-branched portion.

10. The outboard motor of claim 9, wherein the multi-branch section includes two branches and one of the plurality of high-pressure pumps is positioned in each branch.

11. The outboard motor of claim 10, wherein the two branches are connected together at a point downstream of the high-pressure pumps.

12. The outboard motor of claim 9, wherein the fuel system includes a vapor separator, and the multi-branch portion of the fuel circuit communicate with the vapor separator.

13. The outboard motor of claim 9, wherein the fuel system further comprising a pump drive unit, the pump drive unit arranged to drive at least two of the plurality of high-pressure pumps.

14. The outboard motor of claim 13, wherein the pump drive unit includes a cam shaft driven by the crankshaft of the engine, and a cam disposed on the cam shaft and arranged to drive two high pressure pumps.

15. The outboard motor of claim 14, wherein the cam comprises means for enhancing uniform fuel discharge from the fuel injector.

16. The outboard motor of claim 14, wherein the cam is configured and arranged relative to the pumps so as alternate driving the pumps.

17. The outboard motor of claim 16, wherein the fuel system includes a passage that connects together sections of the fuel circuit on the outlet sides of the high-pressure pumps.

18. The outboard motor of claim 17, wherein the fuel system includes a fuel manifold that includes the passage and that communicates with the high pressure fuel pumps and with at least one fuel rail to which the fuel injector is connected.

19. The outboard motor of claim 9, wherein the fuel system further comprises means for driving the high pressure pumps.

20. The outboard motor of claim 9, wherein the fuel system further comprises a fuel rail, a fuel manifold, and a fuel pressure sensor, the fuel manifold connects one of the high-pressure fuel pumps to the fuel rail, the fuel rail connects the fuel manifold to the fuel injector, and the fuel pressure sensor is disposed so as to measure fuel pressure in the fuel manifold.

21. An internal combustion engine comprising a pair of cylinder banks, each of the banks having at least one cylinder, a fuel injector mounted on each of the banks and arranged to provide fuel to the respective cylinder, and a fuel system comprising a fuel circuit, which extends between a fuel tank and the fuel injectors, and a plurality of high pressure fuel pumps disposed within the fuel circuit, each of the pumps connected to a respective fuel injector to supply high pressure fuel to the injector, the pumps being arranged within the fuel circuit such that the inlet of one pump does not communicate with the outlet of another.

22. An outboard motor comprising an internal combustion engine, the engine having at least one variable-volume combustion chamber formed by at least a pair of members, one member being movable relative to the other member, a crankshaft coupled to the one member and joumnaled for rotation within the engine, an intake system configured to provide air to the combustion chamber, and a fuel system including a fuel supply system and at least one fuel injector connected to the fuel supply system and arranged to provide fuel to the at least one combustion chamber, the fuel supply system comprising at least two high pressure fuel pumps and a pump drive unit arranged to drive the two high pressure pumps.

23. The outboard motor of claim 22, wherein the pump drive unit is disposed between the two high pressure pumps.

24. The outboard motor of claim 23, wherein the pump drive unit includes a cam shaft driven by the crankshaft of the engine, and a cam disposed on the cam shaft and arranged to drive two high pressure pumps.

25. The outboard motor of claim 24, wherein the cam comprises means for enhancing uniform fuel discharge from the fuel injector.

26. The outboard motor of claim 24, wherein the cam is formed with an odd number of crests.

* * * * *

UNITED STATES PATENT AND TRADEMARK OFFICE

CERTIFICATE OF CORRECTION

PATENT NO. : 6,494,755 B2
DATED : December 17, 2002
INVENTOR(S) : Masahiko Kato

It is certified that error appears in the above-identified patent and that said Letters Patent is hereby corrected as shown below:

Title page,
Item [73], Assignee, "Kabishiki" should be -- Kabushiki --

Column 12,
Line 11, "joumnaled" should read -- journaled --

Signed and Sealed this

Twenty-sixth Day of August, 2003

JAMES E. ROGAN
*Director of the United States Patent and Trademark Office*